United States Patent [19]

Wilsey

[11] Patent Number: 4,755,658

[45] Date of Patent: Jul. 5, 1988

[54] SEGMENTED HEATER SYSTEM

[75] Inventor: Harvey J. Wilsey, Sherman, Tex.

[73] Assignee: Ultra Carbon Corporation, Bay City, Mich.

[21] Appl. No.: 99,015

[22] Filed: Sep. 21, 1987

Related U.S. Application Data

[62] Division of Ser. No. 796,729, Nov. 12, 1985, Pat. No. 4,703,556.

[51] Int. Cl.[4] ..... H05B 3/08

[52] U.S. Cl. ..... 219/541; 219/553; 373/127; 373/134

[58] Field of Search ..... 361/110, 114, 118, 132, 361/133, 134, 137; 219/541,-552, 553; 156/619; 422/145

[56] References Cited

U.S. PATENT DOCUMENTS

| | | | |
|---|---|---|---|
| 1,189,725 | 7/1916 | Northrup | 373/127 |
| 2,650,254 | 8/1953 | Kremers | 373/110 |
| 2,966,537 | 12/1960 | Witucki et al. | 373/114 |
| 3,004,090 | 10/1961 | Donovan et al. | 373/128 X |
| 3,184,530 | 5/1965 | Properzi | 373/110 |
| 3,359,077 | 12/1967 | Arst | 156/619 |
| 3,469,013 | 9/1969 | Hetherington et al. | 373/134 |
| 3,798,007 | 3/1974 | Bochman et al. | 156/619 |
| 3,860,736 | 1/1975 | Ford | 374/134 X |
| 4,158,695 | 7/1979 | Ishizuka et al. | 422/145 |
| 4,259,278 | 3/1981 | Flegel et al. | 264/81 |
| 4,410,796 | 10/1983 | Wilsey | 219/553 |
| 4,503,319 | 3/1985 | Moritoki et al. | 219/390 |
| 4,533,822 | 8/1985 | Fujii et al. | 219/553 |
| 4,549,345 | 10/1985 | Wilsey | 29/611 |
| 4,703,556 | 11/1987 | Wilsey | 29/611 |

FOREIGN PATENT DOCUMENTS

| | | | |
|---|---|---|---|
| 190222 | 12/1922 | United Kingdom | 373/127 |
| 222008 | 9/1924 | United Kingdom | 373/134 |
| 231090 | 3/1925 | United Kingdom | 373/134 |
| 241256 | 10/1925 | United Kingdom | 373/118 |

*Primary Examiner*—E. A. Goldberg
*Assistant Examiner*—M. M. Lateef
*Attorney, Agent, or Firm*—Learman & McCulloch

[57] ABSTRACT

A zig-zag picket graphite heater for use in high temperature furnaces of the type used for crystal growing, for example, utilizes a plurality of discrete graphite arcuate shell segments having vertically extending slots alternating from the upper and lower ends thereof. The edge pickets are adjacent slots which extend upwardly from the lower end of the segment and have extensions projecting below the other pickets so as to provide pads below the level of the slots. Graphite connectors span the adjacent pads of adjacent arcuate segments and certain of the connectors are also connected to electrical power supply terminals.

13 Claims, 3 Drawing Sheets

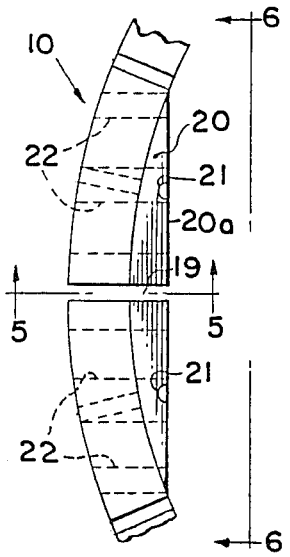
FIG.4
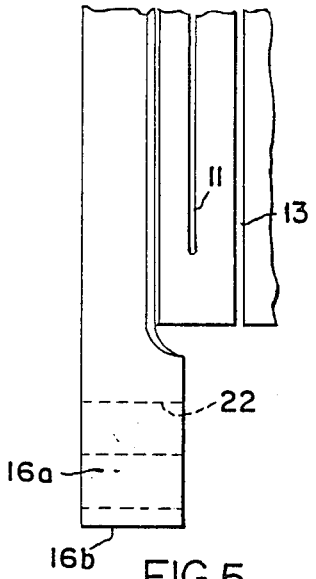
FIG.5
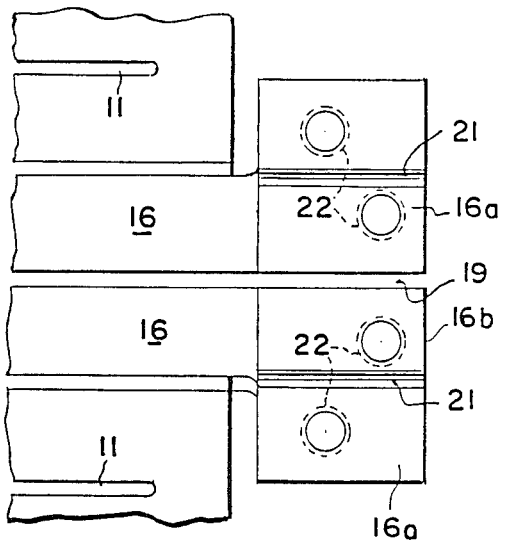
FIG.6
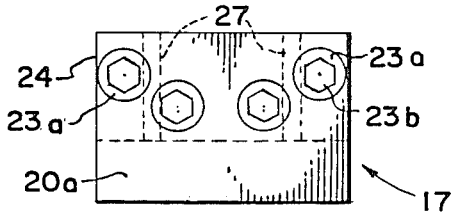
FIG.7
FIG.8
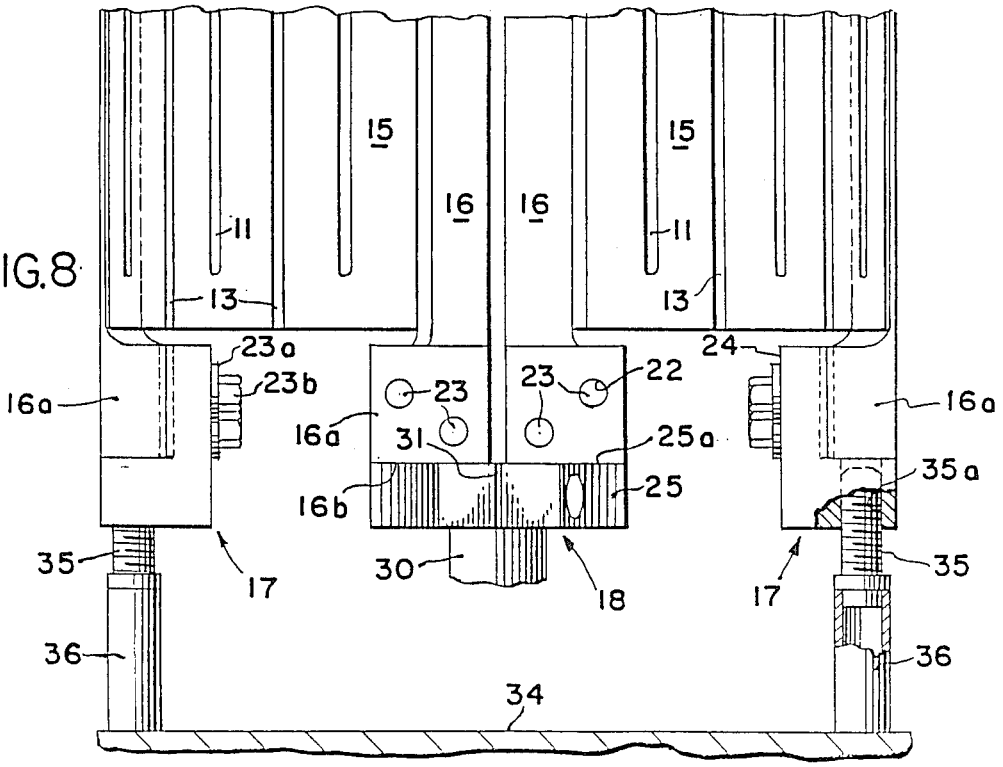

SEGMENTED HEATER SYSTEM

This is a divisional of co-pending application Ser. No. 796,729, filed on Nov. 12, 1985, now U.S. Pat. No. 4,703,556, issued on Nov. 3, 1987.

BACKGROUND OF THE INVENTION

The present invention is directed to zig-zag picket type graphite heater elements for use in crystal growing furnaces and the like, and particularly to heaters wherein a plurality of like graphite cylindrical shell segments are connected in circumferentially separated position, but cylindrical formation, by graphite connector elements, certain of which also function to couple the electrical current source to the heater. The present application is directed to improvements in heater systems of the type disclosed in the present applicant's application Ser. No. 522,727, filed Aug. 12, 1983, now U.S. Pat. No. 4,549,345, which is a division of Ser. No. 323,122, filed Nov. 19, 1981, now U.S. Pat. No. 4,410,796.

DESCRIPTION OF THE PRIOR ART

Present commercial zig-zag picket heating elements are provided in the form of a one-piece cylindrical shell, which surrounds the crucible holding the material to be critically heated. Such heaters are conventionally machined from graphite to function as an electrical resistance heater which produces the relatively high temperatures required, for example, in crystal growing operations. Because such heaters are very expensive, and quite brittle and subject to cracking or chipping while in use, which affects the uniformity of their application of heat to the crucible, the need for the frequent replacement of such heaters has added considerably to the expense of the crystal growing operation. Some of the following patents cited in the afore-mentioned applications are indicative of the present state of the art.

SUMMARY OF THE INVENTION

The present invention is concerned with a segmented graphite heater and a method of assembling a segmented heater system in cylindrical formation. The heater comprises a plurality of circumferentially separated graphite shell segments, each having vertical slots extending alternately from the upper and lower ends thereof, substantially the full length of the segments, to provide pickets in zig-zag array. The edge pickets are adjacent slots which extend upwardly from the lower end of the segment, and these pickets have extensions projecting below the other pickets, which are formed with pads below the level of the slots. Graphite connectors at the level of, and spanning the adjacent pads, are employed below the level of the inboard pickets and slots to connect the segments in cylindrical formation, and certain of the connectors are also utilized to supply electrical power to the pads. The connectors are installable from inside the cylindrically arranged segments and hold the pickets of adjacent segments in absolute vertical alignment so as to maintain substantially the same width between segments as the width of a slot, and thereby provide the uniform heating characteristics which are necessary for crystal growing.

One of the prime objects of the present invention is to provide a segmented heater assembly which can be readily assembled in precise alignment in a very simple and easy manner from the interior of the cylindrically arranged segment. It should be appreciated that heaters of this character may weigh in the neighborhood of 25 to 80 pounds, and need to be installed by people who are not used to lifting heavy weights, and who must reach inside the puller or furnace chamber to accomplish the assembly operation, inasmuch as the exterior of the heater is, for the most part, inaccessible around most of its periphery in modern-day puller chamber installations.

A further object of the invention is to design an improved segmented heater which connects the discrete segments in a manner which not only aids the assembly operation, but also insures the uniform heating and other attributes of monolithic zig-zag heaters, while avoiding their undesirable characteristics.

Other objects and features of the invention will become apparent by reference to the following specification and to the drawings.

IN THE DRAWINGS

FIG. 4 is an enlarged, fragmentary top plan view of adjoining portions of two of the arcuate segments;

FIG. 5 is a transverse, sectional view taken on the line 5—5 of FIG. 4;

FIG. 6 is an interior, elevational view taken on the line 6—6 of FIG. 4;

FIG. 7 is a fragmentary, interior, elevational view taken on the line 7—7 of FIG. 3; and FIG. 8 is a fragmentary, exterior, side elevational view on an enlarged scale, taken on the line 8—8 of FIG. 2.

In the present applicant's aforementioned U.S. Pat. No. 4,410,796, which is incorporated herein by reference, a high temperature furnace is schematically illustrated, and shows a crucible for containing the crystalline material to be pulled, such as molten silicon, surrounded by a zig-zag picket type heater. It is to be understood that the presently improved heater system is to be used in the same manner, and for a more detailed description of the general environment in which such heaters are used, attention is directed to Arst U.S. Pat. No. 3,359,077 and Bochman et al U.S. Pat. No. 3,798,007.

Figure 1:
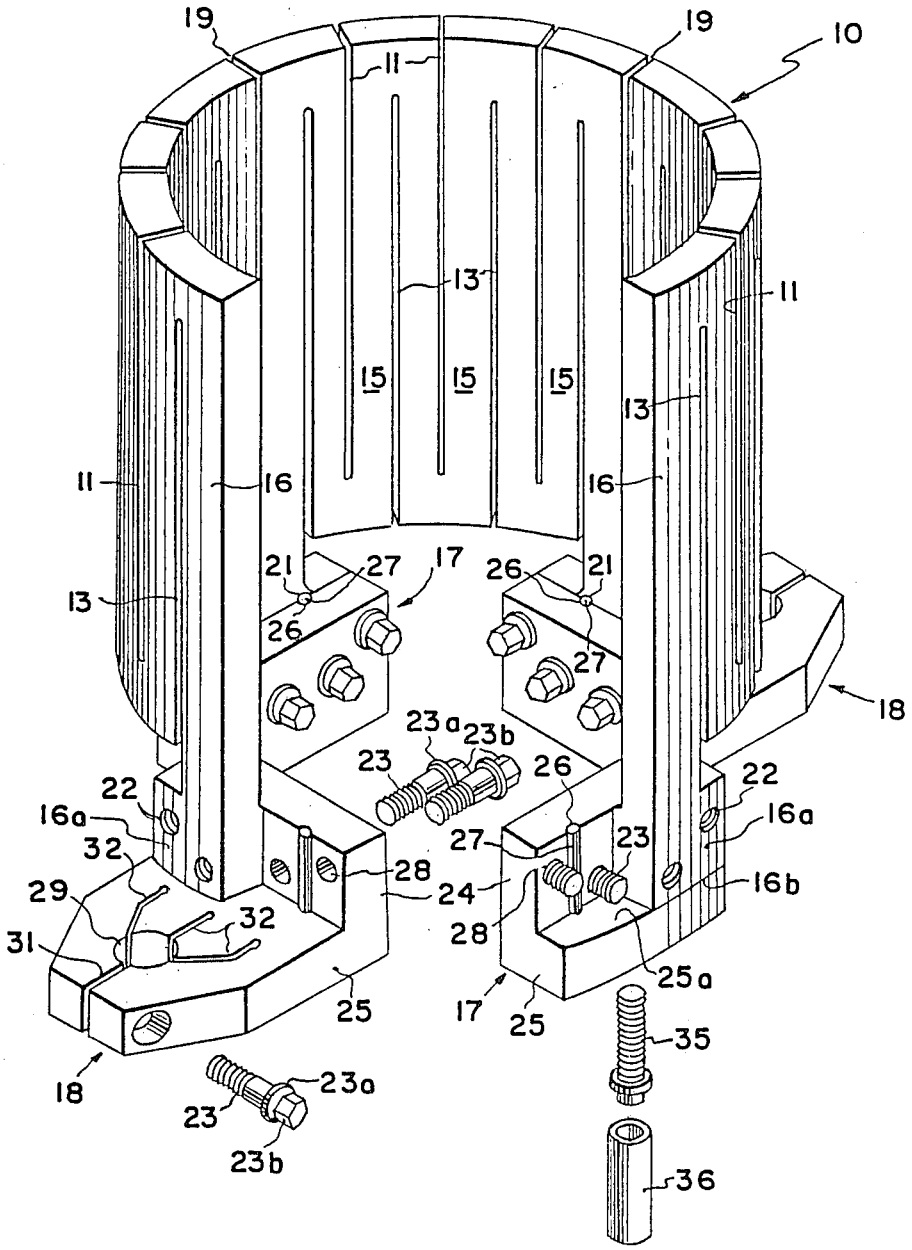
FIG. 1 is a perspective, plan view of the heater with one of the segments removed to expose the interior of the heater, and certain of the parts being shown in exploded position.
Figure 2:
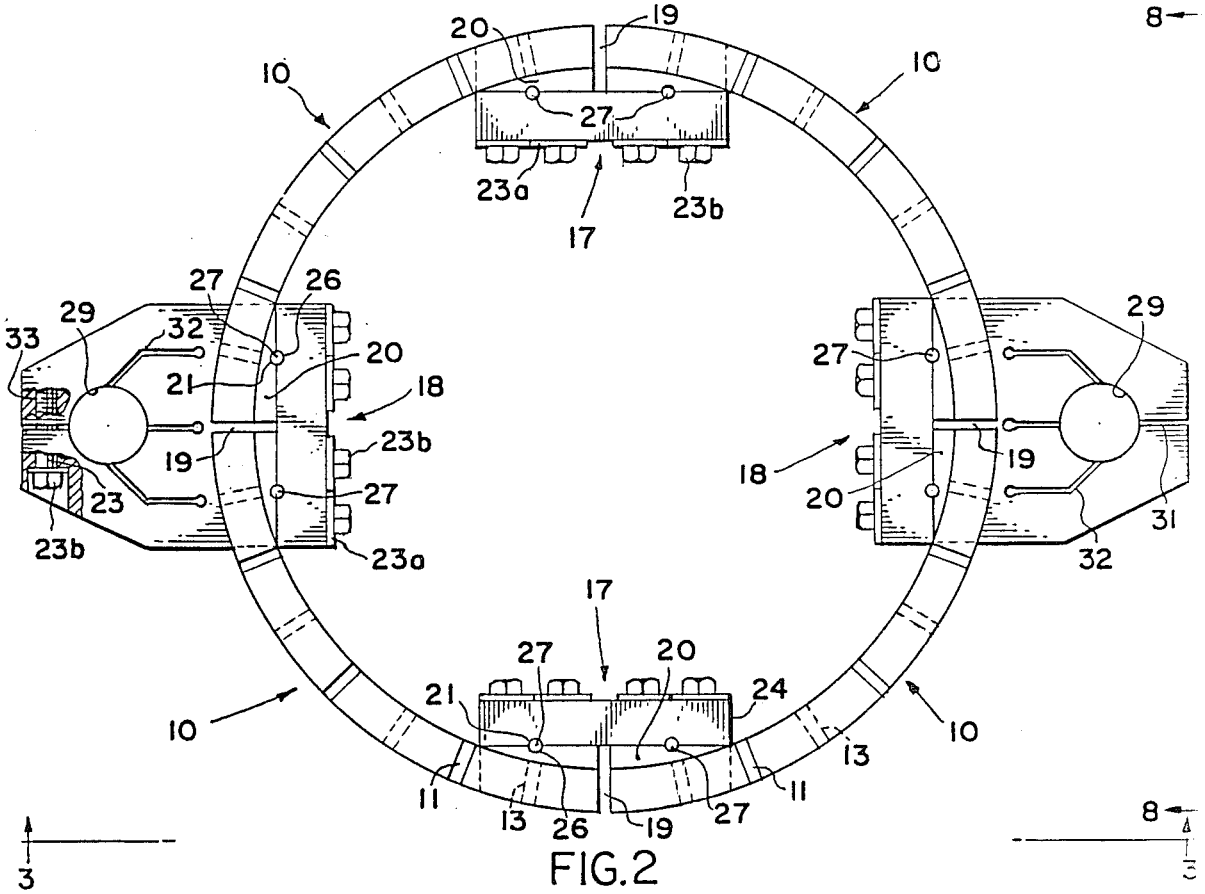
FIG. 2 is a top plan view of the assembled heater.
Figure 3:
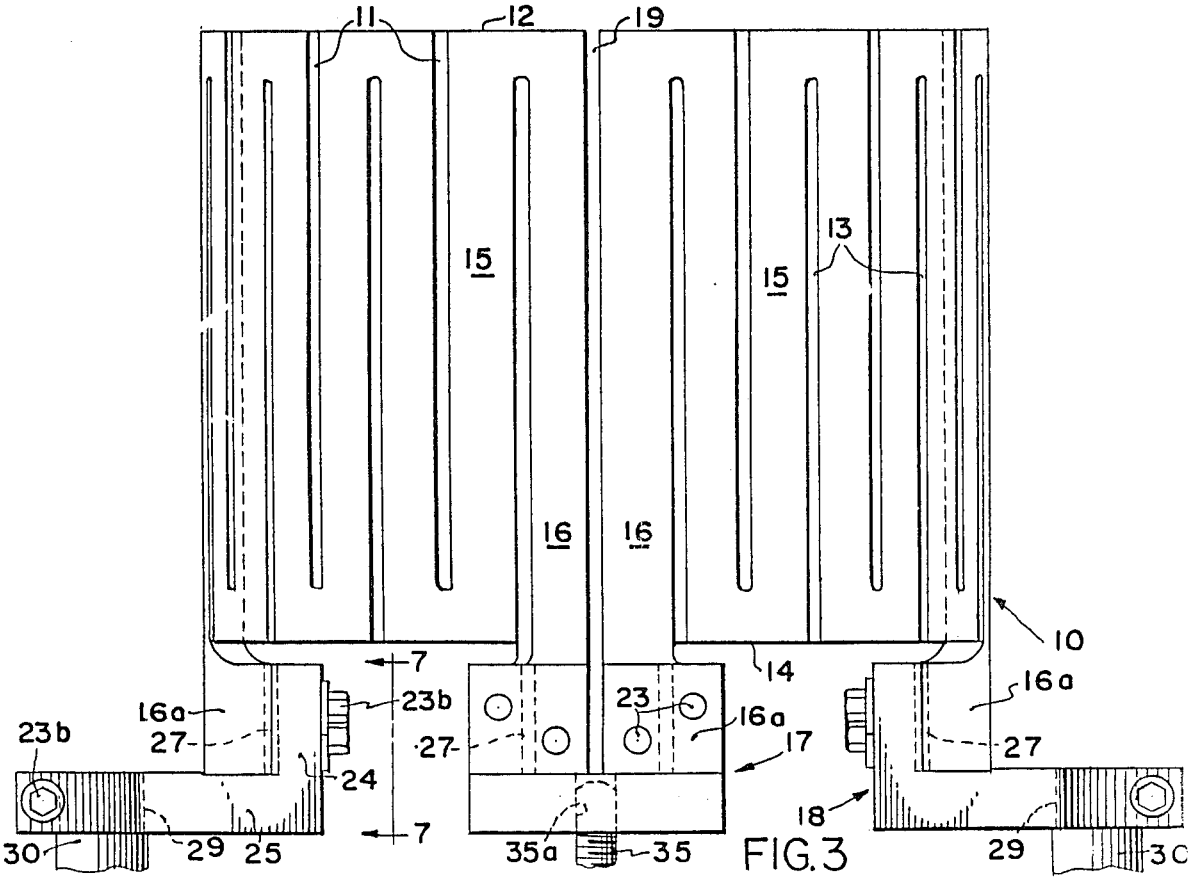
FIG. 3 is a side elevational view thereof, taken on the line 3—3 of FIG. 2.

As best seen in FIGS. 1–3, my improved heater system or assembly includes a series of discrete arcuate segments, generally designated 10 (four being shown in the present drawings), disposed in cylindrical formation in circumferentially spaced relationship. Each of the segments is shell-like and has a first series of slots 11, extending axially downwardly from its top edge 12, and a second series of axially extending slots 13, extending axially upwardly from lower edge 14. The equal width slots 11 and 13, are uniformly circumferentially spaced from each other, and the axial length of slots 11 is equal to the axial length of slots 13. As best seen in FIG. 3, the slots 11 and 13 which alternate circumferentially to provide a series of pickets in zig-zag formation, do not extend for the entire axial length of the heater. As FIG. 1 clearly discloses, the inboard pickets 15 which are all formed are of the same axial length, whereas the outboard, or edge, pickets 16 of each segment 10 extend downwardly below the level of edge 14, and are formed with inwardly projecting, circumferentially enlarged pads 16*a* thereon, which project laterally at a spaced vertical distance below the edge 14.

The heater element 10 may be constructed separately or in the manner previously described, by first machining a cylindrical blank of graphite to the desired final dimensions of the cylindrical shell and then cutting the slots 11 and 13. Four of the slots 11 may then be extended for the full length of the cylindrical heating element at uniformly spaced positions to separate the cylindrical element into four like cylindrical shell segments 10. The separated segments 10 are then reassembled by graphite connectors 17, and graphite power connectors 18, in a condition in which the spaces 19 between adjacent segments 10 is equal to the width of slots 11 and 13. Each of the segments 10 has n end slots 13 and n+1 slots 11. In the present embodiment, each segment 10 has three slots 11 and four slots 13, for example.

Referring now more particularly to FIGS. 4–8, each of the pads 16*a* of the outboard pickets 16 projects radially inwardly of the wall of the picket to form a mount 20 of generally triangular configuration in plan view having a vertically flat mount surface 20*a*, which, for a purpose to be later described, is provided with an axially parallel vertical slot 21. Each pad 16*a*, further is provided with horizontally disposed threaded bores 22 on opposite sides of the slots 21 for receiving graphite screws 23, which have integrated washers 23*a* and hexagonal heads 23*b*.

Screws 23 are provided to secure the upstanding vertical wall 24 of each connector element 17, in bridging relationship to the pads 16*a* of the adjoining outboard pickets 16 of adjoining segments 10. Connectors 17 are also provided with horizontal feet portions 25 with horizontal flat surfaces 25*a* on which the flat lower surfaces 16*b* of the pad 16*a* are received. It is to be observed that mating vertical slots 26 are also milled in the connectors 17 and that the respective slots 21 and 26 receive vertical alignment rib pins 27 to ensure the vertical, axially parallel relationship which guarantees that the space 19 will be uniform from top to bottom, and so of a width equal to the width of slots 11 and 13. Bores 28 are provided in the wall 24, in alignment with the threaded bores 22 provided in the pad 16*a*, to receive the screws 23.

The connectors 18 connect the adjacent pads 16*a* in exactly the same manner. Accordingly, the description will not be repeated, and the same numerals have been utilized to identify like parts. The connectors 18 differ in that the horizontally extending feet 25 thereof are extended and have vertical openings 29 for receiving power supplying electrodes 30 (see FIG. 3). The outer ends of the feet 25 are preferably split as at 31 (see FIG. 1), and inboard portions thereof are also slotted as at 32 to provide gripping capability. Also, a threaded bore 33 is provided in each power connector foot 25 for a screw 23 which is used to clamp the power electrodes 30 in position. Provided to support the connectors 17 from the bottom 34 of the puller chamber, are screw jacks 35 which extend into threaded openings 35*a* in the feet 25 and which are received on suitable ceramic or quartz insulator tubes 36.

The arrangement disclosed finds the quadricylindrical segments 10 detachably assembled to each other, with the individual segments concentric about a common central axis. The zig-zag current flow path provides a more uniform heat circumferentially above level 14, in the space in which the crucible is disposed. Within this space, each picket is of the same width and the same thickness, and the spacing of the pickets is uniform. Cracking or chipping of an individual picket 10 requires only that that an individual segment be replaced, and does not require the scrapping of the entire heater. The electrical circuit may be that disclosed in the present assignee's aforementioned U.S. Pat. No. 4,410,796, and any suitable source of power may be utilized.

When installing the heater system, or replacing one of its segments, it should be apparent that assembly can be readily achieved by placing the segments 10 in formation, and simply inserting the pins 27 in the openings provided, which ensures correct alignment so that the screws 23 may be inserted and utilized to clamp the connectors and segments in assembled relation.

While one embodiment of the invention only has been described, it will be apparent to those skilled in the art that the disclosed embodiment may be modified. Therefore, the foregoing description is to be considered exemplary, rather than limiting, and the true scope of the invention is that defined in the following claims.

What is claimed is:

1. An improved zig-zag picket graphite heater for use in crystal growing furnaces and the like, comprising: a plurality of circumferentially separated, graphite arcuate shell segments, each having vertical slots extending alternately from the upper and lower ends thereof, substantially the full length of the segments to provide pickets in zig-zag array providing a zig-zag current path, the edge pickets being adjacent slots which extend upwardly from the lower end of the segment and having extensions projecting below the other pickets so as to provide pads below the level of said slots; graphite connectors at the level of and spanning the adjacent pads of adjacent arcuate segments below the level of said slots to connect said segments in cylindrical formation; and electrical power connections to certain of said connectors to supply electrical power to said pads.

2. The improved heater of claim 1 wherein said pads have portions projecting circumferentially inwardly from the edge pickets.

3. The improved heater of claim 2 in which the pads project radially inwardly of the pickets and the radially inner face of said pads is flat, and said connectors have vertical walls which are flat to mate therewith.

4. The improved heater of claim 3 in which said connectors have radially outwardly projecting surfaces receiving the bottom faces of said pads thereon.

5. The improved heater of claim 4 in which said radially outwardly projecting surfaces of the connectors are horizontally projecting and have flat upper surfaces; and the lower surfaces of said pads matching flat surfaces.

6. The improved heater of claim 1 in which a pair of vertically extending alignment rig means are provided to mate each of the connectors with said pads, and maintain a uniform spacing substantially that of the width of said slots between the end pickets of adjacent segments.

7. An improved zig-zag picket graphite heater for use in crystal growing furnaces and the like, comprising: a plurality of circumferentially separated, graphite arcuate shell segments, each having vertical slots extending alternately from the upper and lower ends thereof, substantially the full length of the segments to provide pickets in zig-zag array providing a zig-zag current path, the edge pickets flanking other pickets and being adjacent slots which extend upwardly from the lower end of the segment and having extensions projecting below the other pickets so as to provide pads spaced below the level of said slots; discrete graphite connectors at the level of and spanning the adjacent pads of adjacent arcuate segments below the level of said slots to connect said segments in cylindrical formation; alignment maintaining means interacting between said pads and connectors to maintain a uniform spacing substantially that of the width of the segment slots between the edge pickets of adjacent segments, and electrical power connections to certain of said connectors to supply electrical power to said pads.

8. The improved heater of claim 7 wherein said pads have portions projecting circumferentially inwardly from the edge pickets.

9. The improved heater of claim 8 in which the pads project radially inwardly of the pickets and the radially inner face of said pads is flat, and said connectors have vertical walls which are flat to mate therewith.

10. The improved heater of claim 9 in which said connectors have radially outwardly projecting surfaces receiving the bottom faces of said pads thereon.

11. The improved heater of claim 10 in which said radially outwardly projecting surfaces of the connectors are horizontally projecting and have flat upper surfaces; and the lower surfaces of said pads have matching flat surfaces.

12. The improved heater of claim 7 in which a pair of vertically extending alignment rib means are provided to mate each of the connectors with said pads, and maintain a uniform spacing substantially that of the width of said slots between the end pickets of adjacent segments.

13. The heater of claim 7 wherein said connectors and pads are formed with mating, axially parallel, vertical alignment slots and alignment pins are disposed therein.

* * * * *

UNITED STATES PATENT AND TRADEMARK OFFICE

CERTIFICATE OF CORRECTION

PATENT NO. : 4,755,658

DATED : July 5, 1988

INVENTOR(S) : Harvey J. Wilsey

It is certified that error appears in the above-identified patent and that said Letters Patent is hereby corrected as shown below:

Column 4, line 55, after "pads" insert -- have -- ; line 58, change "rig" to -- rib -- .

Signed and Sealed this

Fourth Day of October, 1988

*Attest:*

DONALD J. QUIGG

*Attesting Officer*

*Commissioner of Patents and Trademarks*